US007549929B1

(12) United States Patent
Pines et al.

(10) Patent No.: US 7,549,929 B1
(45) Date of Patent: Jun. 23, 2009

(54) DETERMINING A BOWLING GAME SCORE

(75) Inventors: Andrew Pines, Chicago, IL (US); Brian Steelglove, Rolling Meadows, IL (US)

(73) Assignee: Cosmodog, Ltd., Chicago, IL (US)

( * ) Notice: Subject to any disclaimer, the term of this patent is extended or adjusted under 35 U.S.C. 154(b) by 59 days.

(21) Appl. No.: 11/948,467

(22) Filed: Nov. 30, 2007

(51) Int. Cl.
*A63F 5/00* (2006.01)

(52) U.S. Cl. ..... 473/54

(58) Field of Classification Search ..... 473/54, 473/70, 71
See application file for complete search history.

(56) References Cited

U.S. PATENT DOCUMENTS

| | | | | | |
|---|---|---|---|---|---|
| 2,550,915 | A | * | 5/1951 | Curran | 340/323 R |
| 2,931,656 | A | | 4/1960 | Hooker | |
| 3,063,719 | A | | 11/1962 | Rosenberger | |
| 3,145,025 | A | * | 8/1964 | Morrison et al. | 473/67 |
| 3,825,749 | A | | 7/1974 | Gautraud et al. | |
| 3,887,183 | A | * | 6/1975 | Saso | 473/76 |
| 4,597,575 | A | * | 7/1986 | Kosof | 473/54 |
| 4,884,806 | A | * | 12/1989 | Brim | 473/54 |
| 4,935,721 | A | * | 6/1990 | Kato | 340/323 B |
| 5,039,977 | A | | 8/1991 | Mele et al. | |
| 5,115,125 | A | | 5/1992 | Biggs | |
| 5,118,105 | A | * | 6/1992 | Brim et al. | 473/58 |
| 5,171,013 | A | * | 12/1992 | Dooley | 273/118 A |
| 5,419,549 | A | | 5/1995 | Galloway et al. | |
| 5,582,549 | A | * | 12/1996 | File | 473/54 |
| 5,882,549 | A | * | 3/1999 | Zuber et al. | 252/514 |
| 5,902,188 | A | | 5/1999 | Meniconi | |
| 6,017,278 | A | * | 1/2000 | Benko | 473/70 |
| 6,142,880 | A | * | 11/2000 | Titus | 473/54 |
| 6,319,142 | B1 | * | 11/2001 | Ciniello | 473/54 |
| 7,094,164 | B2 | | 8/2006 | Marty et al. | |
| 2004/0242292 | A1 | | 12/2004 | Hansen | |

FOREIGN PATENT DOCUMENTS

| | | |
|---|---|---|
| JP | 10211314 | 11/1998 |

* cited by examiner

*Primary Examiner*—William M. Pierce
(74) *Attorney, Agent, or Firm*—Banner & Witcoff, Ltd.

(57) ABSTRACT

Methods and systems for determining a bonus bowling score may include determining a speed with which bowling pins are knocked down by a player. The speed may correspond to a bonus score that may be used, in some configurations, to break ties. In one arrangement, a bowling game may determine a reference time at which a bowling ball crosses a predefined location in a bowling lane. A speed time may be determined based on when a last of the pins that have been knocked down has fallen. A bonus score may then be determined based on the difference between the speed time and the reference time. In one example, the smaller the difference (i.e., faster speeds), the higher the bonus score. Bonus scores might only be used in tie breaking situations. Alternatively, bonus scores may be used in regular scoring.

21 Claims, 9 Drawing Sheets

300

| Knockdown Speed (s) | Score modifier |
|---|---|
| 0 to 0.1 | 1.0 |
| 0.11 to 0.2 | 0.9 |
| 0.21 to 0.3 | 0.8 |
| 0.31 to 0.4 | 0.7 |
| 0.41 to 0.5 | 0.6 |
| 0.51 to 0.6 | 0.5 |
| 0.61 to 0.7 | 0.4 |
| 0.71 to 0.8 | 0.3 |
| 0.81 to 0.9 | 0.2 |
| 0.91 to 1 | 0.1 |
| 1.1 + | 0 |

FIG. 3

800

| Player ID (805) | Score (807) | Bonus (809) |
|---|---|---|
| 15 | 143 | 190505 |
| 2 | 144 | 247587 |
| 12 | 145 | 93385 |
| 4 | 145 | 190189 |
| 6 | 148 | 151405 |
| 5 | 161 | 69926 |
| 7 | 167 | 186690 |
| 14 | 169 | 215965 |
| 9 | 169 | 270456 |
| 17 | 172 | 259123 |
| 11 | 176 | 39344 |
| 1 | 183 | 76134 |
| 13 | 190 | 388790 |
| 8 | 191 | 454489 |
| 3 | 196 | 350933 |
| 16 | 200 | 337743 |
| 10 | 233 | 654206 |

FIG. 8

DETERMINING A BOWLING GAME SCORE

FIELD OF ART

The invention relates generally to bowling. More specifically, aspects of the invention provide methods and systems for determining a game score, modifying a game score, and/or breaking ties in bowling tournaments based on a characteristic of a bowling frame.

BACKGROUND

The game of bowling involves knocking down a set of pins placed at the end of a bowling lane using a bowling ball. A bowling score is determined based on the number of pins that are knocked down in a given frame. In games where participants are highly skilled, players may get strikes (i.e., knocking down all pins in 1 throw) or spares (i.e., knocking down all pins in 2 or more throws) on a regular basis. Thus, the scores in such games can be quite close and in many instances, result in ties. The large number of ties is compounded by the maximum score a bowler may receive in a traditional ten frame bowling game being 300. In tournaments with more than 300 players, there will be ties. In tournaments with thousands of players or more, there will be ties at all skill levels, and the winner of such tournaments is often difficult to determine unless a multi-game, bracket or ladder system is used.

SUMMARY

The following presents a simplified summary of the invention in order to provide a basic understanding of one or more aspects of the invention. This summary is not an extensive overview of the invention, and is not intended to identify key or critical elements of the invention or to delineate the scope of the invention. The following summary merely presents some concepts of the invention in a simplified form as a prelude to the more detailed description provided below.

According to an aspect of the invention, the high probability of ties in a single game bowling tournament with large numbers of players is mitigated by ranking tied bowlers based on the quality of each bowler's throws or shots. In one example, strikes and/or spares that knock down pins quickly may be considered higher quality shots or throws than strikes and/or spares that knock down pins more slowly. Players may be ranked more highly or player scores may be enhanced when a player throws a particularly good strike or spare (e.g., the player knocks down all the pins quickly), thereby reducing the probability of a tournament resulting in a tie.

A method and system for determining a bonus score or score modifier based on a speed with which one or more pins fall or are knocked down is described. A reference time may be determined based on when a bowling ball reaches a predefined location in a bowling lane. A second time (e.g., a speed determination time) may be determined based on when a last pin has been knocked down or fallen to the deck. A difference between the reference time and the second time may then be used to determine a shot quality modifier or score. In one example, a scoring calculus mapping speeds to quality scores or modifiers may be used to determine a shot quality score or modifier corresponding to a particular speed. In another example, the shot quality score or modifier may be calculated based on a formula or algorithm. The shot quality modifier or score may then be applied to a player's score or a player's ranking. For example, a shot quality modifier may be multiplied with a maximum bonus score. The resulting bonus score may subsequently be added to the player's score or used to rank tied players. In one or more arrangements, the reference time may be defined by a time at which a bowling ball is launched, or may be defined by a time at which the bowling ball crosses a predefined threshold in front of the bowling pins. Bonus scoring may be used in virtual bowling games (e.g., video games) or in live bowling events.

In one or more live bowling events, sensors may be used to determine the relevant shot quality determination times. For example, motion sensors may be used to detect when a bowling ball crosses a predetermined point in a bowling lane. Alternatively or additionally, pins may include one or more sensors (e.g., an accelerometer) for detecting when each pin has fallen. Each of the pin falling times may then be compared to determine the time at which the last pin fell.

According to one aspect, a bonus score may be used to break ties in a bowling game. Thus, a bonus score might only be used when a tie exists at the end of the game. Alternatively or additionally, bonus scores may be applied for multiple frames of a bowling game.

These as well as other advantages and aspects of the invention are apparent and understood from the following detailed description of the invention, the attached claims, and the accompanying drawings.

BRIEF DESCRIPTION OF THE DRAWINGS

The present invention is illustrated by way of example and not limited in the accompanying figures in which like reference numerals indicate similar elements and in which:

FIG. 3 illustrates a scoring table for converting a time into a speed or shot quality score.

FIG. 8 illustrates a scoring table listing scores for multiple players according to one or more aspects described herein.

DETAILED DESCRIPTION

Figure 1:
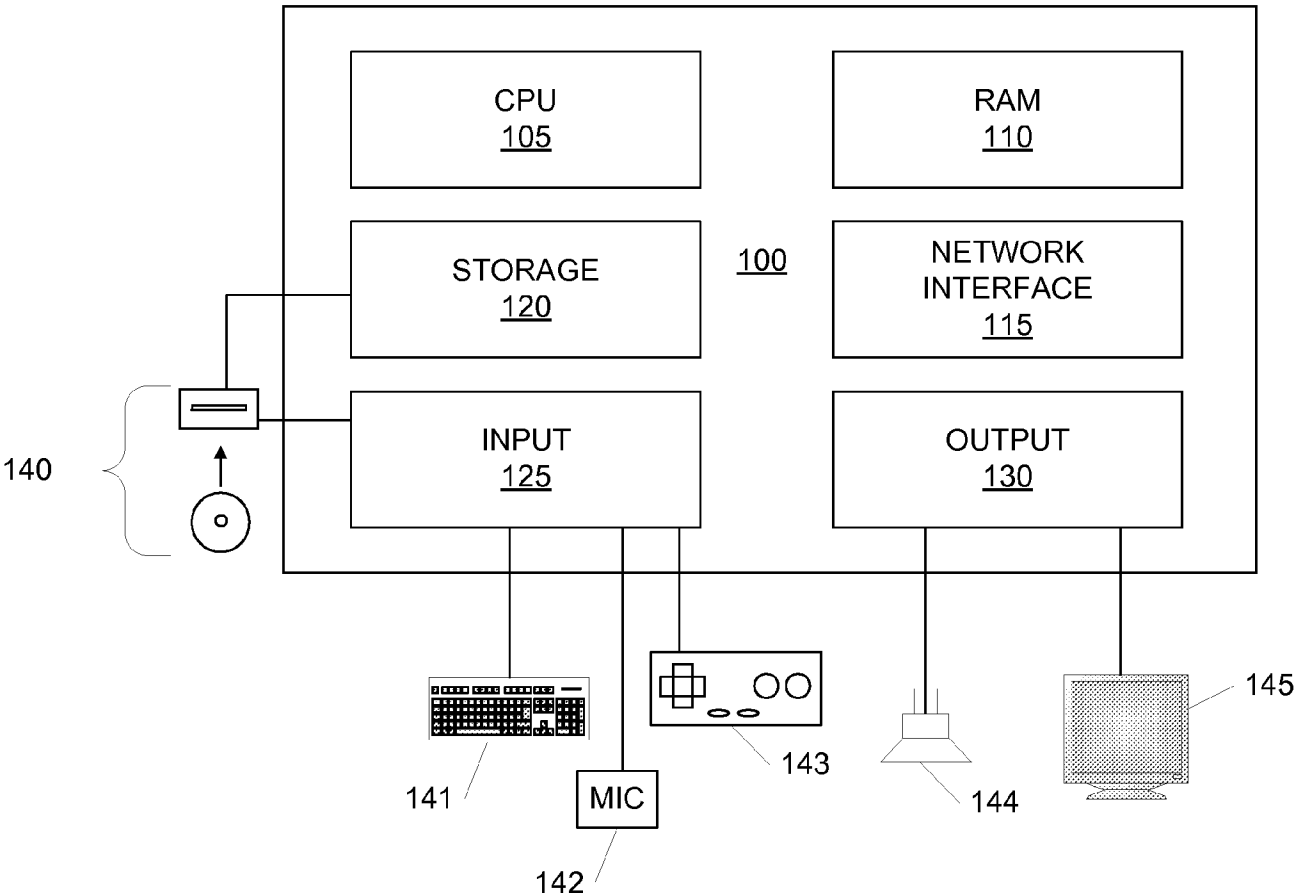
FIG. 1 illustrates a block diagram of a general computing device and associated peripherals in which various embodiments may be implemented.

In the following description of the various embodiments, reference is made to the accompanying drawings, which form a part hereof, and in which is shown by way of illustration various embodiments in which the invention may be practiced. It is to be understood that other embodiments may be utilized and structural and functional modifications may be made without departing from the scope of the present invention.

In a typical bowling game, a player's goal is to knock down as many pins as possible. A number of points (i.e., a score) is awarded to the player based on the number of pins knocked down. In one game arrangement, a bowling game may include multiple rounds or frames, each frame including up to two possible throws of the bowling ball to knock down ten pins placed in a triangular arrangement at the end of a bowling lane. If a player is able to knock down all of the pins on the first try or throw (also known as a strike), the player may be awarded a first number of points. If a player gets a strike, the player usually does not receive a second throw for that frame because all pins have already been cleared. Alternatively, if the player does not knock down one or more pins in the first throw, but is able to knock down a remainder of the pins on the second try or throw (i.e., a spare), the player may be awarded a second number of points. Various sizes, numbers and configurations of pins may be used. Additionally, any number of throws may be allowed in a given frame and any number of frames may be played. For example, in some duckpin and candlepin bowling game configurations, three throws may be allowed per frame.

According to one aspect, if a player throws a strike in a particular frame, the player may be awarded a number of points for that frame equal to the number of pins knocked down in that frame plus the number of pins knocked down with each of the next two throws. Thus, in ten pin bowling, if a player gets strikes in each of the first three frames, the player would be awarded 30 points for the first frame (i.e., 10 points for the pins knocked down in the first frame+10 points for the pins knocked down in the second throw+10 points for pins knocked down in the third throw). If a player throws a spare in a given frame, the player may be awarded a number of points for that frame equal to the number of pins knocked down in the frame plus the number of pins knocked down in the player's next one throw. If the player does not get a strike or a spare, the player typically only receives one point for each pin knocked down that frame. Variations in scoring may be used or applied depending on the game configuration and/or player preferences. One variation using bonus scoring is described in detail below.

In live bowling, a player throws a spherical ball down a bowling lane, targeting a set of pins located in an end region of the lane. Depending on various characteristics of the ball and throw (e.g., speed, trajectory, spin and/or weight of the bowling ball) a number of pins may be knocked down. In an alternative configuration, a player may play a virtual bowling game that simulates the various aspects of the game including a bowling lane, a set of pins, the bowling ball, a speed, spin and trajectory of the bowling ball and the knocking down of pins. The virtual bowling game may determine a number of pins to knock down and a corresponding score based on algorithms that take into the account various simulated aspects, including simulations of real-world physics. Virtual bowling games may be played on various computing devices including personal computers (PCs), game consoles, handheld devices, mobile communication devices, arcade style machines and the like. As used herein, the term "video game" includes any implementation of a virtual bowling game.

FIG. 1 illustrates a block diagram of a general purpose computing device 100 with associated peripherals 140, 141, 142, 143, 144 and 145 in which various aspects may be implemented. Computing device 100 may include multiple components 105, 110, 115, 120, 125 and 130 for providing numerous functionalities. A central processing unit (CPU) 105 is included in device 100 for performing computations, executing programs and applications and the like. CPU 105 may retrieve instructions from random access memory (RAM) 110 that provides temporary storage of program or application instructions that require processing by CPU 105. RAM 110 is generally faster to access than main memory such as storage 120. Read only memory (ROM, not shown) may also be included in device 100 for storing startup instructions for the memory, and other permanent instructions. ROM might not be changeable whereas RAM 110 may change contents depending on the currently executing application or applications. The ROM may further maintain its contents even after device 100 has been turned off. Storage 120 may include devices such as a hard drive, optical disks, flash memory and the like. Typically, storage 120 provides space to store applications, system files, content files such as videos and music, as well as other types of data. Applications may be accessed from storage 120 and executed on device 100 using CPU 105. For example, executable instructions may be generated by the application programming (software) and stored to RAM 110 for execution by processor 105.

Device 100 may receive data and other input from a variety of sources including network devices (not shown) via a network interface 115. Network interface 115 may coordinate communications between device 100 and a network system or device (not shown) using networking protocols such as TCP/IP, UDP, SMTP, FTP and the like. Input may also be received through an input module 125 that manages incoming data from various sources such as optical disk drive 140, microphone 141, keyboard 142 and gamepad controller or control panel 143. The input interface 125 may include different ports for different types of input devices. For example, interface 125 may provide a Universal Serial Bus (USB) port for keyboard 142 which connects using a USB plug. Alternatively, an external optical disk drive similar to drive 140 may be connected to computing device 100 through a parallel port, serial port, USB port, etc. In yet another arrangement, control pad or game controller 143 may send input signals to device 100 through an infrared port. Optical disk drive 140 may further provide storage capabilities and include a connection to storage unit 120 for external storage of data.

Further, device 100 may also output signals and data to one or more peripheral devices such as speaker 144 and video display 145. Audio signals from music or an audio track of a content file may be played through speaker 144. A video portion of the same or different content file may be simultaneously rendered on display 145. Output module 130 may include a variety of interfaces and adapters to insure compatibility with output devices 144 and 145. For example, output module 130 may include a display adapter for providing the correct type and/or form of display signals to display 145. Output module 130 may further store control functions associated with output devices 144 and 145 such as volume control and brightness controls. In one or more arrangements, input received by input module 125 from control pad 143 may affect the rendering of one or more elements of a user interface displayed on display 145. For example, input from control pad 143 may control the movement and position of a bowling ball in a video game outputted on display 145.

While general computing device 100 has been described with respect to one specific embodiment, one of skill in the art will appreciate that a variety of configurations may be used.

One variation in or addition to scoring in a bowling game may include applying bonus scoring based on the speed with which pins are knocked down. Taking into account the speed with which pins are knocked down may introduce another level of skill, differentiation and/or complexity to the game. Additionally, allowing scoring adjustments or player ranking modifications based on such a speed factor allows for tie-breaking in bowling games or tournaments featuring a large number of competitors. In one example, the faster the pins are knocked down, the more bonus points that may be awarded. That is, knocking down pins with a faster speed may represent a better or greater quality throw. Thus, a larger bonus may be awarded based on the perceived higher quality of the shot. Without a tie-breaking score such as the shot quality or speed score bonus, bowling games having many competitors may result in many unbreakable ties.

Figure 2:
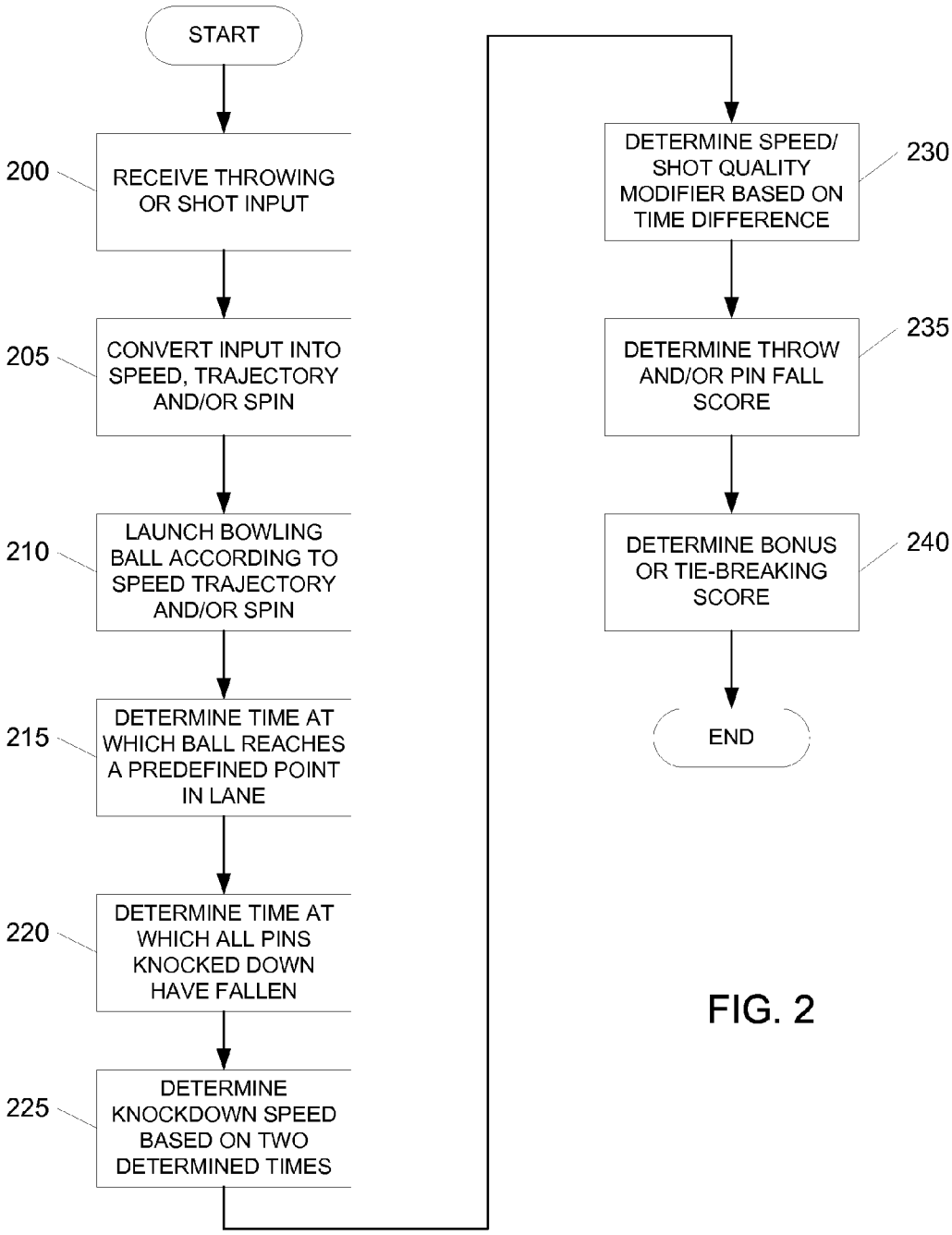
FIG. 2 is a flowchart illustrating a method for determining a speed or shot quality score according to one or more aspects described herein.

FIG. 2 is a flowchart illustrating a method for determining a knock down speed score in a bowling game. In step 200, throwing input may be received for throwing a bowling ball. For example, in a video game a user may spin a rotatable input device at a given speed and/or direction. Other input devices may include a touch pad or a joystick device. The speed and direction may be detected using various sensor devices and received as input. In step 205, the various components of the throwing input may be translated or converted into a bowling ball speed, trajectory and/or spin. In one or more arrangements, a user may activate and define spin by entering a specified input or sequence of input. For example, to activate spin, a user may be required to initially rotate a rotatable input element sideways or backwards before defining a direction or angle of spin. That is, by initially rotating the input element sideways or backwards, the user may activate a spin mode. Various other spin mechanisms and methods may be also be used. In step 210, the bowling ball may be launched down a bowling lane according to the determined bowling ball speed, trajectory and/or spin.

Subsequently, in step 215, the bowling game may determine a time at which the bowling ball passes a predefined point or line in a bowling lane. The predefined point may be any specified point in the lane, e.g., the tail plank, a foot fault line (i.e., the launching point), a point at the middle of the lane, a threshold in front of the head pin, and the like. In step 220, the bowling game may determine a time at which all of the pins to be knocked down have fallen. For example, the bowling game may determine when the last of all ten pins falls as a result of single throw, or when the last of five remaining pins falls as a result of a second throw in a frame. The speed with which pins fall may be determined based on the parameters of the throw such as speed, spin and trajectory. In one example, a faster thrown ball may knock down pins faster than a slower thrown ball. A video game may simulate real world physics to determine how fast one or more pins fall down.

In step 225, the bowling game may then determine a knockdown speed (i.e., a difference between the time at which the bowling ball reaches the predefined point in the bowling lane and the time at which all of the pins to be knocked down have fallen). Using the time difference or knockdown speed, the bowling game may determine a speed or shot quality modifier in step 230. For example, a scoring calculus may be used that translates a difference in time to a shot quality score on a scale of 0 to 1 where 0 represents the lowest shot quality score or modifier and 1 corresponds to the highest. A scale of 0 to 1 may be used to prevent a first player's score from being adjusted above a second player's score based on throw quality if the second player has a higher pin fall score than the first player. Such a method prevents a shot quality modifier from being used to make up for knocking down fewer pins. Thus, the upper end of the shot quality scale (i.e., 1 in the above example) may equal the number of points assigned to a single pin fall.

In one embodiment, knockdown speeds slower than or faster than a predefined maximum and minimum knockdown speeds, respectively, may be clamped to the maximum or minimum speeds. For example, a bowling game may define a minimum knockdown speed to be 0.2 s and a maximum knockdown speed to be 1.5 s. Thus, any shots with knockdown speeds greater than 1.5 s would be assigned a knockdown speed of 1.5 s, while any shots with knockdown speeds faster than 0.2 s would be assigned a knockdown speed of 0.2 s. Knockdown speeds between the predefined maximum and minimum might not be converted or clamped. Thus, a knockdown speed of 0.35 s may remain 0.35 s. The shot quality modifier or score may be then be calculated using the following formula:

$$\text{Shot Quality Modifier} = \frac{(\text{Max Knockdown Speed} - \text{Actual Knockdown Speed})}{(\text{Max Knockdown Speed} - \text{Minimum Knockdown Speed})}$$

In step 235, a score for the throw (throw score) may be calculated based on the number of pins actually knocked down by a particular throw. In one configuration for example, 1 point may be awarded for each pin knocked down. Additionally, a frame and/or overall score (e.g., pin fall score) may be updated or calculated based on the throw score. In step 240, the speed or quality modifier may be used to determine a bonus or tie-breaking score. In one arrangement, the shot quality modifier may be used as the bonus or tie-breaking score. In an alternative arrangement, a player's bonus or tie-breaking score may be determined by multiplying a maximum possible bonus or tie-breaking score by the shot quality modifier. In one example, a maximum possible bonus or tie-breaking score may be 10,000. Thus, using the above example where the shot quality modifier is based on a scale of 0 to 1, if a player's shot quality modifier is 0.8, the player would receive a bonus or tie-breaking score of 8,000. This bonus or tie-breaking score may be added to the player's overall score, used independently of the overall score or a combination thereof. For example, if two players have both achieved a score of 295, the bonus or tie-breaking score may be used to rank the two players and determine a winner.

According to one aspect, bonus or tie-breaking scores may only be determined for strikes. Alternatively, bonus or tie-breaking scores may be determined for any number of types of shots. Further, bonus or tie-breaking scores may be determined for each qualifying shot (e.g., only strikes, only strikes and spares, all types of shots) and added to a total bonus score that may be used at the end of a game to break ties.

FIG. 3 illustrates a scoring table where various speeds correspond to various speed or quality scores that may be used in addition to or as an alternative to the shot quality modifier formula discussed above. In one example, scoring table 300 may be derived based on a shot quality modifier formula. Table 300 defines that any speed between 0 and 0.1 seconds corresponds to a quality modifier of 1. Additionally, speeds between 0.11 and 0.2 seconds correspond to a quality score of 0.9 and so on. Thus, table 300 may be stored as a scoring look-up table in the memory of a computing device such as computing device 100 (FIG. 1) and used to determine the appropriate speed or quality score. Alternatively or additionally, a formula may be defined and used to calculate a speed or quality score using the determined speed. Alternatively or additionally, scoring table 300 may include a shot quality score for each distinct possible speed instead of for a range of speeds.

Referring again to FIG. 2, in a video game embodiment of a bowling game, a processing system or device may calculate the time at which a bowling ball is to pass a predefined point as well as the time at which the last of a number of pins is to fall prior to the displaying the launching and rolling of the bowling ball and/or the knocking down one or more pins. Thus, even though the visual display of the bowling ball crossing a predefined location and the pins being knocked down might occur in a predefined order, the determination of the times at which the events occur might be performed in any order and is not limited to the order of steps 210 and 215. Further, in live bowling events, steps 200 and 205 may be omitted or considered to be performed as human brain activity controlling muscles, as simulation of the throwing would not be needed. Instead, the scoring method may begin from the launch of the bowling ball (e.g., step 210).

Figure 4A:
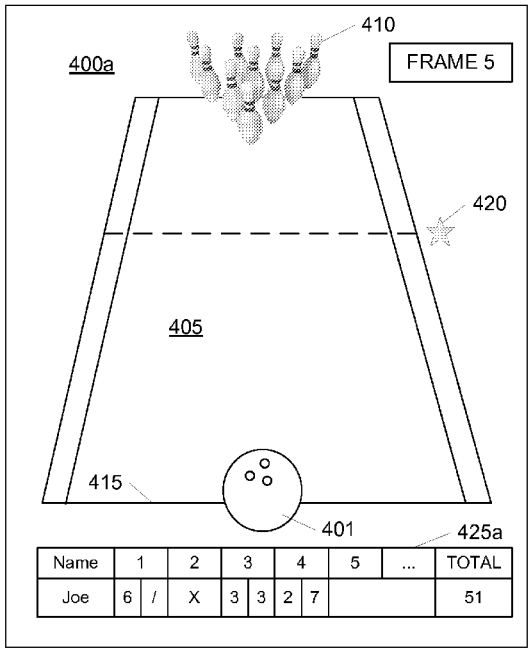
FIGS. 4A-4D illustrate a bowling game during various phases according to one or more aspects described herein.

FIG. 4A illustrates a bowling game interface 400*a* in which bowling ball 401, bowling lane 405 and pins 410 are graphically depicted on a display prior to bowling ball 401 being launched. Bowling ball 401 may be placed below (or behind) foot fault line 415 as a starting location. The position of bowling ball 401 may be modified based on user input. Additionally, speed determination location (i.e., location at which a first time is determined) may optionally be marked by symbols or letters such as indicator 420 while a current score may be displayed in score display 425*a*.

Figure 4B:
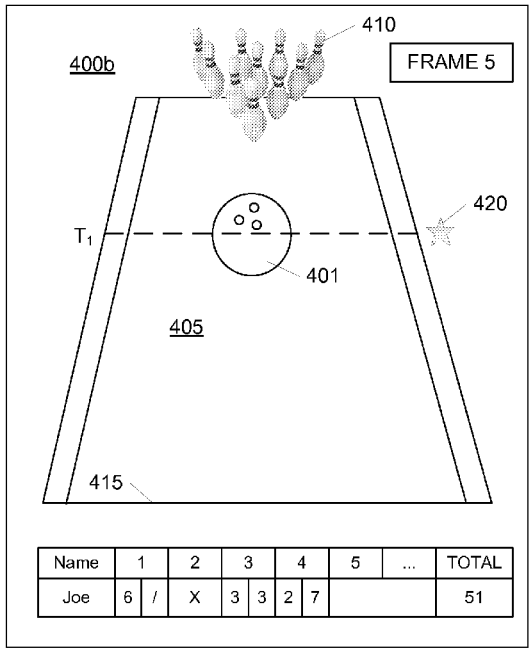

FIG. 4B illustrates bowling game interface 400*b* in which bowling ball 401 has been launched down bowling lane 405. A first time $T_1$ may be determined based on when bowling ball 401 reaches or is scheduled to reach the speed determination location identified by indicator 420. Thus, in one or more configurations, as bowling ball 401 crosses the location identified by indicator 420, time $T_1$ may be displayed (e.g., to simulate real time timing/scoring) or just stored in memory for future use.

Figure 4D:
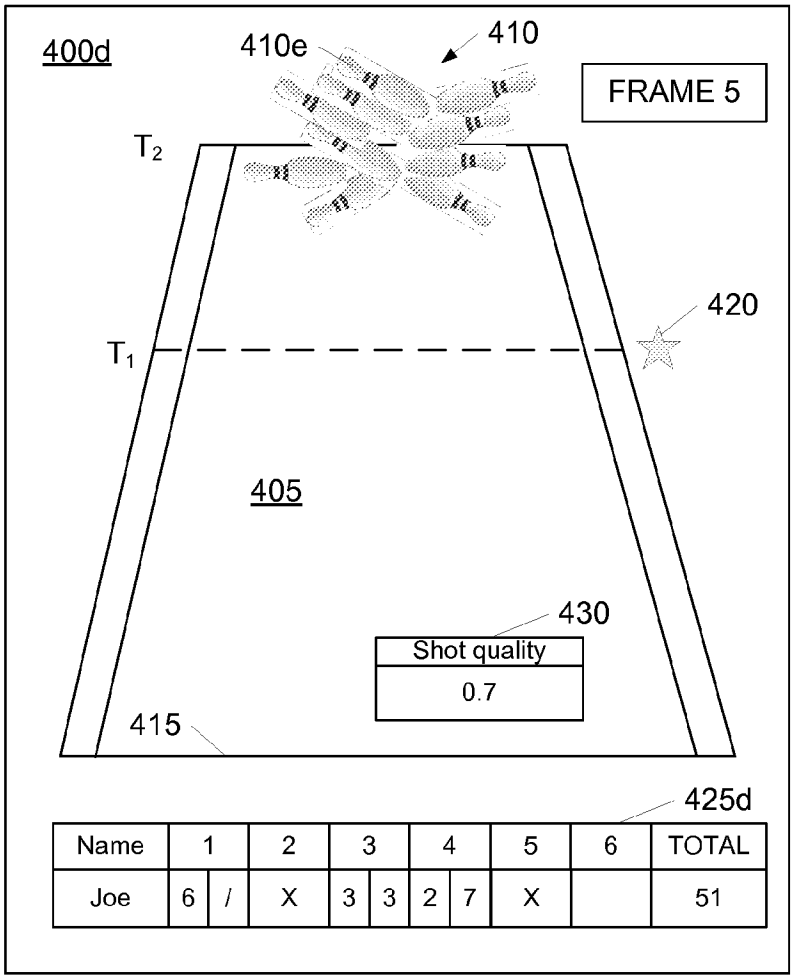
Figure 4C:
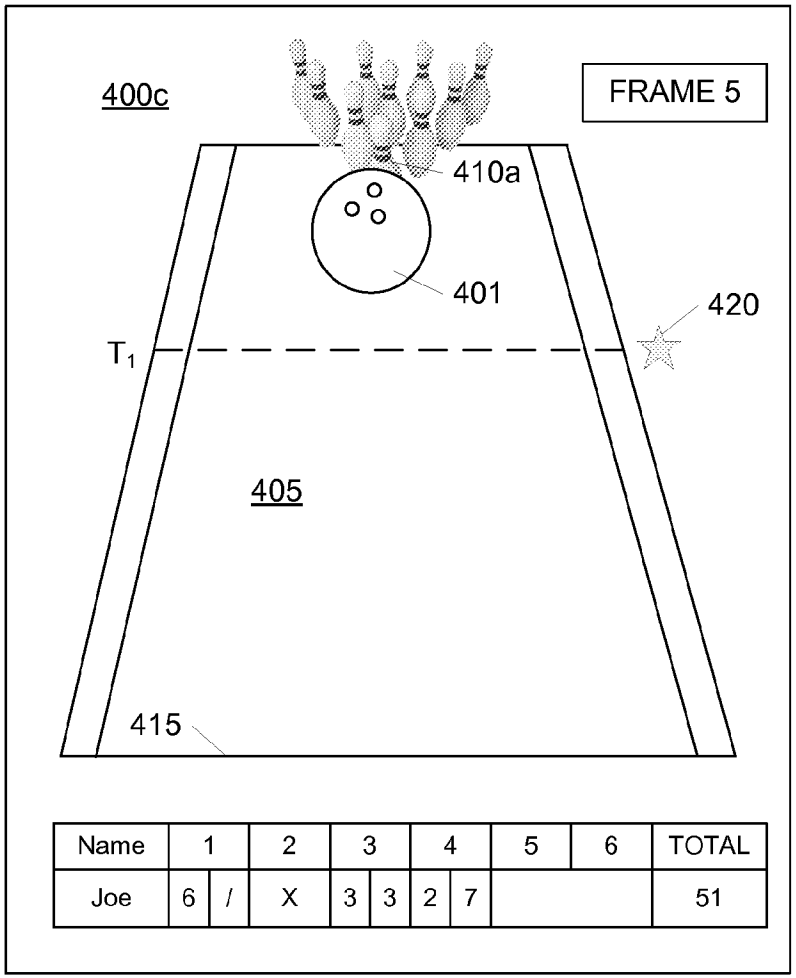

FIG. 4C illustrates bowling game interface 400*c* in which bowling ball 401 makes initial contact with pin 410*a*. In FIG. 4D, all of pins 410 have been knocked down (i.e., the player threw a strike). In one or more instances, pin 410*e* may be the last pin to be knocked down. In such instances, a second time $T_2$ may be displayed in interface 400*d* to represent a time at which the last of pins 410 (e.g., pin 410*e*) has fallen to the deck, or time $T_2$ may just be stored for future use. A speed or shot quality score optionally may be displayed in quality score display 430 once a difference between $T_1$ and $T_2$ has been determined. Quality score display 430 may be a temporary element of interface 400*d* that may be hidden after a predetermined amount of display time. Additionally, score display 425*d* may be updated with the shot information (i.e., an 'X' for a strike is displayed for frame 5). Note, however, the total score might not be updated since the score for a strike depends on subsequent throws.

Figure 5:
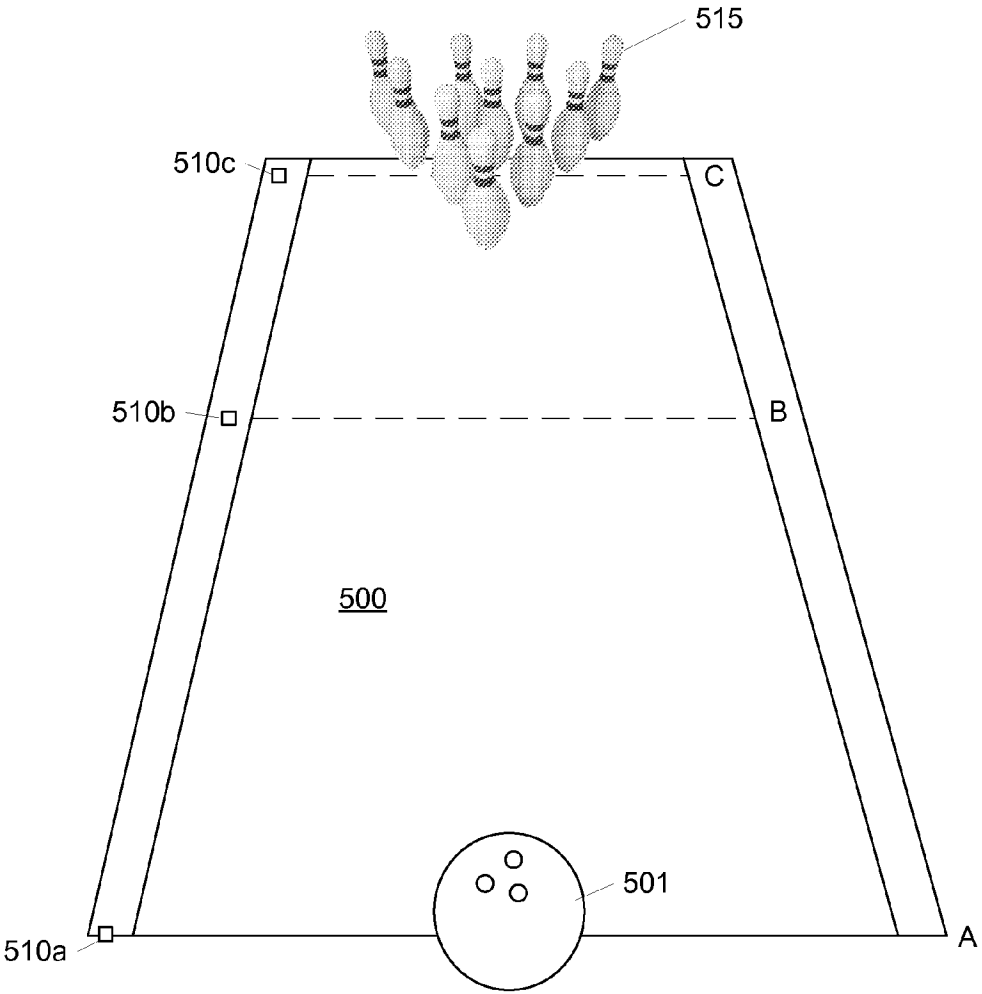
FIG. 5 illustrates a live bowling game environment in which one or more sensors may be used to detect the relevant times according to one or more aspects described herein.

In live bowling arenas, bowling lanes may include one or more devices for determining relevant speed times. FIG. 5 illustrates a bowling lane 500 in which predefined locations A, B and C specify speed determination locations. Locations A, B and C may be defined by a distance from foot fault line or some other fixed point in lane 500. Sensors 510 may be placed on one or more sides of lane 500 at locations A, B and/or C to detect when bowling ball 501 reaches that location. Each sensor 510 may include an infrared sensor, or other light-based sensor that detects when an object interrupts a light beam, or may include any other type of sensor that can detect when an object crosses a predetermined line of a bowling alley. Additionally or alternatively, bowling ball 501 may include a tracking device such as a radio frequency ID (RFID) chip that may be detected by a proximity sensor when the bowling ball reaches location A, B or C. Additionally, pins 515 may include one or more sensors for determining when a pin has fallen to the deck. For example, pins 515 may include gyroscopic sensors, pressure sensors for detecting impact, accelerometers and the like. Further, a determination system may compare the times of all pins to determine which pin was last to fall and use the fall or knockdown time associated with that pin for shot quality determination purposes.

Figure 6:
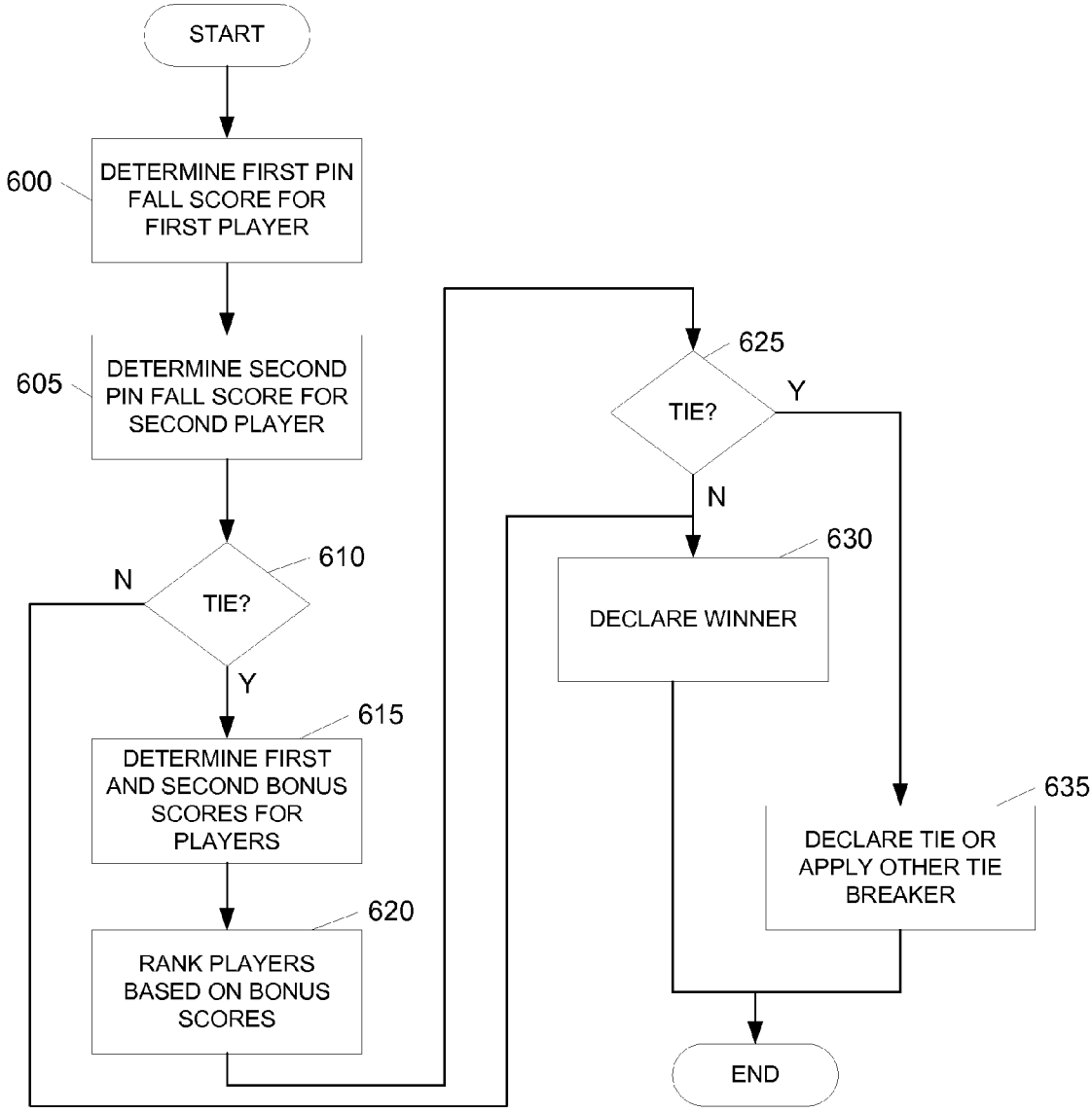
FIG. 6 is a flowchart illustrating a method for determining when to use bonus scoring and for determining a bowling game winner according to one or more aspects described herein.

FIG. 6 is a flowchart illustrating a method for determining when to use bonus scoring and for determining a winner. In step 600, a first pin fall score for a first player may be determined based on one or more played frames (e.g., a ten-frame game). In step 605, a second pin fall score for a second player may be determined based on one or more played frames. In step 610, a bowling game may determine whether a tie exists between the first pin fall score and the second pin fall score. If a tie does not exist, a winner may be declared in step 630. In response to determining that a tie exists, however, the bowling game may determine a first bonus or tie-breaking score associated with the first player and a second bonus or tie-breaking score associated with the second player in step 615. The first and second bonus or tie-breaking scores may correspond to a most recent throw, represent a composite bonus or tie-breaking score for all applicable frames/throws during the game, include an average of all throws or represent a best bonus or tie-breaking score from all played frames. In step 620, the first and second players may be ranked based on the determined first and second bonus or tie-breaking scores, respectively. In step 625, a determination may be made to whether a tie still exists. If not, a winner may be declared based on the higher bonus or tie-breaking score in step 630. If, however, a tie still exists, a tie may be declared in step 635. Alternatively, one or more other tie breaking systems may be used (e.g., most strikes, most spares, least splits, etc.).

Figure 7:
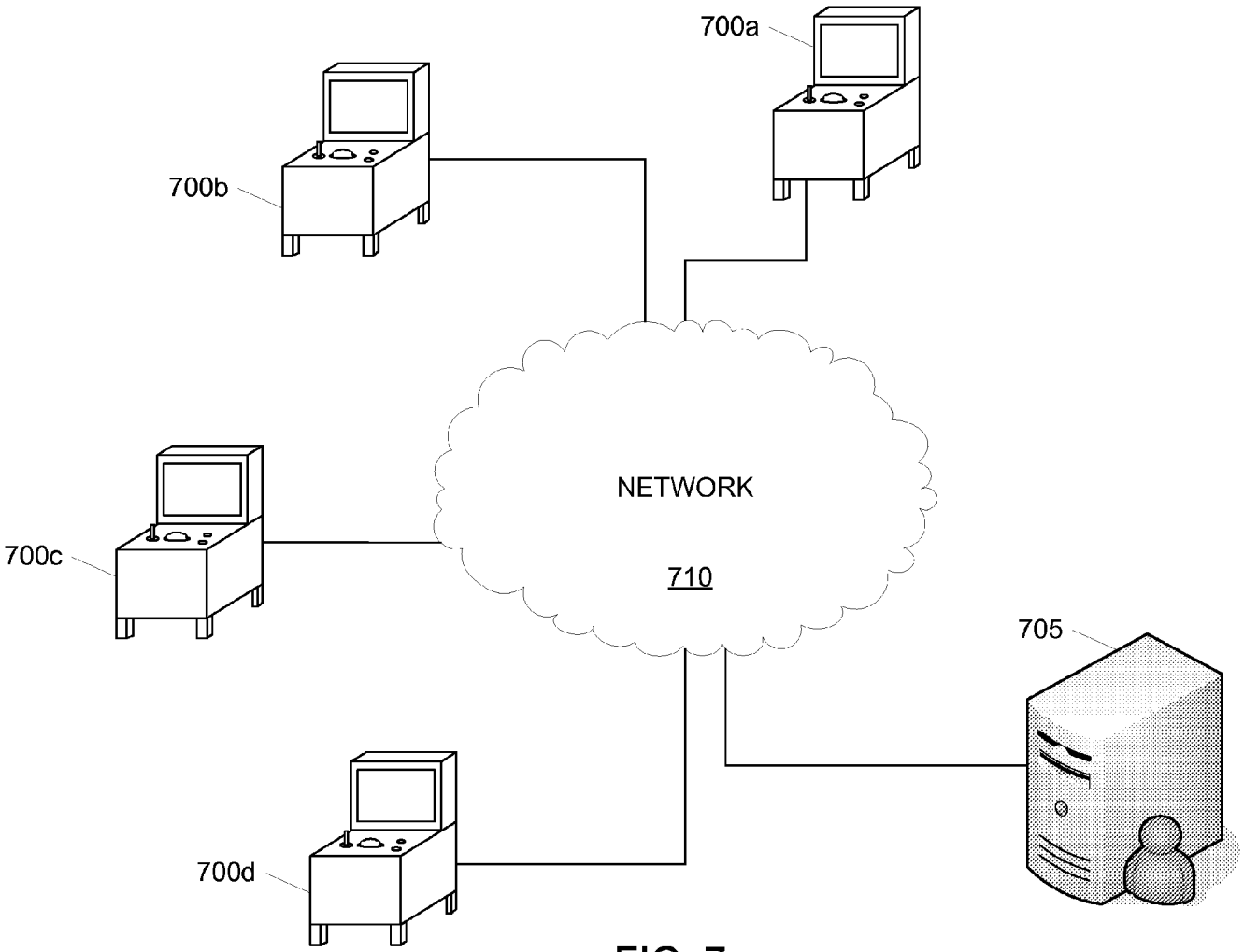
FIG. 7 illustrates a networked gaming environment in which multiple game machines and a game server may be connected through a network according to one or more aspects described herein.

FIG. 7 illustrates a network environment in which multiple bowling game consoles 700*a*-700*d* may be networked together for head-to-head or tournament style play through network 710. The network environment may further include a game server 705 that may be configured to perform a variety of processes. Server 705 and consoles 700 may be located in the same physical location or may be located in different locations. Game server 705 may be responsible for recording scores and/or shot quality information received from each of consoles 700, determining whether a tie exists between two or more players, transmitting game flow signals to consoles 700 and the like. In one or more configurations, each of consoles 700 may transmit score information to server 705 after each throw or based on a periodic or aperiodic schedule (e.g., after each frame, when a player presses a "NEXT FRAME" option). Additionally, server 705 may control when each of consoles 700 are authorized to receive input (i.e., enter a play mode). Such control may be used to conform a networked game between consoles 700 to turn-by-turn style play. Alternatively, server 705 may allow players to concurrently play a particular frame, but restrict the players from moving on to the next frame until all players are finished with the current frame. Server 705 may exercise such control by sending signals to each of consoles 700 configured to activate a specified mode of the game (e.g., player mode, wait mode, etc.). In yet another alternative configuration, a server 705 might not restrict the flow of the game and instead, may allow each player to progress at their own desired pace.

Shot quality modifier and score information may be stored in the individual consoles 700, server 705 or both. Further, calculation of scores and the determination of shot quality modifiers may also be performed at each of consoles 700, at server 705 or at both locations. In one example, server 705 may perform score and shot quality calculations to verify that the determinations made by consoles 700 are valid and correct, or to authenticate each console 700 to confirm that a console has not been tampered with. The identification of ties and the use of shot modifiers to break ties may also be performed by server 705 if each of consoles 700 does not have shot quality data for each of the other consoles 700.

Additionally or alternatively, data received by server 705 from each of consoles 700 may be distributed to each of the other consoles so that players may track the scores of other players. In one example, each of consoles 700 may display a scoring grid for all players in the game, or some subset of players in the game. The scoring grid may thus be updated by data transmitted from server 705. Various transmission and security protocols may be used to insure the integrity of the transmission and of the data being transmitted.

FIG. 8 illustrates scoring data in table format that may be received from multiple players (i.e., players 1-17) in a bowling game. Table 800 may be ordered from lowest to highest pin fall score and from lowest to highest bonus score. Player ID column 805 may specify a player id such as a number, random or pseudo-random alphanumeric string, a name and the like. In the illustrated embodiment, table 800 includes scoring information for 17 players. Score column 807 includes the pin fall score (i.e., score based on a number of pins knocked down) for each player while bonus column 809 includes a bonus score for one or more throws. Thus, players may be ranked and ties may be broken using the data stored in scoring data 800. For example, table 800 indicates that players 14 and 9 each scored 169 pin fall points. However, player 9 achieved a bonus score of 270456 while player 14 only achieved a bonus score of 215965, resulting in a tie-breaking victory for player 9.

According to one or more arrangements, a shot quality modifier may be determined for and applied to each frame score of a bowling game. Thus, a shot quality modifier may be taken into account by the cumulative scoring effects of consecutive strikes or spares. Additionally, there might not be a need to determine whether a tie exists since shot quality has already been incorporated into the score.

While the methods and systems discussed herein relate to determining a first time using a first predefined location in a bowling lane as a point of reference, a bowling ball throwing or launch time may also be used as a reference time. Thus, a difference in time may be determined based on the launch time and a time at which the last of the pins to fall has fallen.

The methods and features recited herein may further be implemented through any number of computer readable media that are able to store computer readable instructions. Examples of computer readable mediums that may be used include RAM, ROM, EEPROM, flash memory or other memory technology, CD-ROM, DVD or other optical disk storage, magnetic cassettes, magnetic tape, magnetic storage and the like.

The present invention has been described in terms of preferred and exemplary embodiments thereof. Numerous other embodiments, modifications and variations within the scope and spirit of the appended claims will occur to persons of ordinary skill in the art from a review of this disclosure.

We claim:

1. A method for scoring a bowling game, the method comprising:

determining a first time at which a first bowling ball reaches a predefined location in a bowling lane;

determining a second time at which one or more pins knocked down by the first bowling ball have fallen; and determining a first bonus score based on a difference between the first time and the second time.

2. The method of claim 1, wherein the first bowling ball reaches the predefined location of the bowling lane prior to the one or more pins have fallen.

3. The method of claim 1, wherein the bonus score is different from a bowling score determined based on the number of pins knocked down by the first bowling ball.

4. The method of claim 1, further comprising:

receiving user input corresponding to the launching of the first bowling ball;

determining a trajectory of the first bowling ball based on the received user input; and determining a number of pins to be knocked down based on the determined trajectory.

5. The method of claim 1, further comprising:

determining a third time at which a second bowling ball reaches the predefined location of the bowling lane;

determining a fourth time at which one or more pins knocked down by the second bowling ball have fallen, wherein a number of pins knocked down by the second bowling ball is the same as a number of pins knocked down by the first bowling ball; and determining a second bonus score based on a difference between the third time and the fourth time, wherein the second bonus score is different from the first bonus score.

6. The method of claim 1, wherein the first bonus score is determined based on a score modifier applied to a predefined maximum bonus score.

7. The method of claim 1, wherein the second time is defined by when a last pin of the one or more pins knocked down by the first bowling ball has fallen.

8. One or more computer readable media storing computer readable instructions that, when executed by a processor, cause the processor to perform a method comprising:

determining a first time at which a first bowling ball reaches a predefined location in a bowling lane;

determining a second time at which one or more pins knocked down by the first bowling ball have fallen; and determining a first bonus score based on a difference between the first time and the second time.

9. The one or more computer readable media of claim 8, wherein the first bowling ball reaches the predefined location of the bowling lane prior to the one or more pins have fallen.

10. The one or more computer readable media of claim 8, wherein the bonus score is different from a bowling score determined based on the number of pins knocked down by the first bowling ball.

11. The one or more computer readable media of claim 8, further comprising instructions for:

receiving user input corresponding to the launching of the first bowling ball;

determining a trajectory of the first bowling ball based on the received user input; and determining a number of pins to be knocked down.

12. The one or more computer readable media of claim 8, further comprising instructions for:

determining a third time at which a second bowling ball reaches the predefined location of the bowling lane;

determining a fourth time at which one or more pins knocked down by the second bowling ball have fallen, wherein a number of pins knocked down by the second bowling ball is the same as a number of pins knocked down by the first bowling ball; and determining a second bonus score based on a difference between the third time and the fourth time, wherein the second bonus score is different from the first bonus score.

13. The one or more computer readable media of claim 8, wherein the first bonus score is determined based on a score modifier configured to be applied to a predefined maximum bonus score.

14. The one or more computer readable media of claim 8, wherein the second time is defined by when a last pin of the one or more pins knocked down by the first bowling ball has fallen.

15. An apparatus comprising:

a processor; and memory storing computer readable instructions that, when executed, cause the processor to perform a method comprising:

determining a first time at which a first bowling ball reaches a predefined location in a bowling lane;

determining a second time at which one or more pins knocked down by the first bowling ball have fallen; and determining a first bonus score based on a difference between the first time and the second time.

16. The apparatus of claim 15, wherein the bonus score is different from a bowling score determined based on the number of pins knocked down by the first bowling ball.

17. The apparatus of claim 15, the memory further storing instructions for:

receiving user input corresponding to the launching of the first bowling ball;

determining a trajectory of the first bowling ball based on the received user input; and determining a number of pins to be knocked down.

18. The apparatus of claim 17, further comprising a rotatable input device for receiving the user input.

19. The apparatus of claim 15, the memory further storing instructions for:

determining a third time at which a second bowling ball reaches the predefined location of the bowling lane;

determining a fourth time at which one or more pins knocked down by the second bowling ball have fallen, wherein a number of pins knocked down by the second bowling ball is the same as a number of pins knocked down by the first bowling ball; and determining a second bonus score based on a difference between the third time and the fourth time, wherein the second bonus score is different from the first bonus score.

20. The apparatus of claim 15, wherein the second time is defined by when a last pin of the one or more pins knocked down by the first bowling ball has fallen.

21. One or more computer readable media storing computer readable instructions that, when executed by a processor, cause the processor to perform a method comprising:

determining a first score for a first player, wherein the first score is based on a first strike;

determining a second score for a second player, wherein the second score is based on a second strike, wherein the first score is equal to the second score;

determining a first knockdown speed of a first set of pins corresponding to the first strike;

determining a second knockdown speed of a second set of pins corresponding to the second strike; and ranking the first player and the second player based on the first and second knockdown speeds.

* * * * *